US005636748A

United States Patent [19]

Arvidson

[11] Patent Number: 5,636,748

[45] Date of Patent: Jun. 10, 1997

[54] MAGNETIC DRUM SEPARATOR

[76] Inventor: Bo R. Arvidson, 825 Colorow Rd., Golden, Colo. 80401

[21] Appl. No.: 367,449

[22] Filed: Dec. 29, 1994

[51] Int. Cl.[6] ..... B03C 1/00

[52] U.S. Cl. ..... 209/223.2; 209/213; 209/228

[58] Field of Search ..... 209/213, 219, 209/223.1, 223.2, 228, 231, 217

[56] References Cited

U.S. PATENT DOCUMENTS

| | | | |
|---|---|---|---|
| 1,414,170 | 4/1922 | Bethke et al. | 209/223.2 X |
| 2,535,719 | 12/1950 | Blind | 209/219 |
| 2,959,288 | 11/1960 | Fowler | 209/219 X |
| 2,992,738 | 7/1961 | Maynard | 209/223.2 X |
| 3,552,565 | 1/1971 | Fritz | 209/223.2 X |

FOREIGN PATENT DOCUMENTS

| | | | |
|---|---|---|---|
| 43 23 932 | 2/1995 | Germany . | |
| 1294381 | 3/1927 | U.S.S.R. | 209/223.2 |

OTHER PUBLICATIONS

"Rare Earth Permanent Magnetic Separators and Their Applications in Mineral Processing", Presented at the Society for Mining, Metallurgy, and Exploration, Inc., Annual Meeting, Feb. 1993.

*Primary Examiner*—William E. Terrell
*Assistant Examiner*—Tuan N. Nguyen
*Attorney, Agent, or Firm*—Timothy J. Martin; Michael R. Henson

[57] ABSTRACT

A magnetic drum separator for separating components having different magnetic properties out of an aggregate material employs a drum rotatably driven on a longitudinal axis. The drum has a cylindrical shell sidewall to have an open interior wherein a magnetic array is disposed. The magnetic array is formed by a plurality of longitudinally extending and circumferentially spaced ferromagnetic bars. A first magnet is disposed between each pair of circumjacent bars, and circumjacent first magnets have similar magnetic poles facing the bar located therebetween. Second magnets extends longitudinally and a second magnet is located radially inwardly of each of a majority of the bars. Circumjacent second magnets have oppositely oriented polarities, all in the radial direction, and each second magnet has a similar pole facing the respective bar as those of the first magnets. The array is supported by an arcuate support plate and a pair of brackets secured to a rigid shaft about which the drum rotates. The array has an arcuate active surface in closely-spaced relation concentric to the drum sidewall, and this arcuate surface preferably extends between 45° and 120° of arc.

25 Claims, 3 Drawing Sheets

MAGNETIC DRUM SEPARATOR

FIELD OF THE INVENTION

The present invention is directed to material separators adapted to separate particulate material into components thereof based upon the magnetic properties of such components. Specifically, however, the present invention concerns magnetic drum separators of a type having a high field strength magnet assembly disposed internally of a drum so that, as material is advanced by the sidewall surface of the drum, differing trajectories are imparted to the components based upon differing magnetic attraction to the magnetic array.

BACKGROUND OF THE INVENTION

A processing step of separating an aggregate material into various components has proved highly valuable in modern industrial processes. Many different separation techniques have been utilized in the past with these techniques relying on differing characteristics of the components of the aggregate, such as size, weight, specific gravity, solubility in different solvents, etc. It has long been recognized in certain industrial processes that the separation of a particulate material into magnetic and non-magnetic components has particular utility. Among various magnetic separation apparatus, two particular assemblies enjoy wide-spread use in the dry and wet separation of particulate materials.

A first type of magnetic separation apparatus is known as a high-intensity magnetic roll separator. Typically, a magnetic roll separator is configured to have a cylindrical magnetic roller located at a downstream end and a cylindrical idler roller located an upstream end. A relatively thin conveyor belt encircles the magnetic roller and the idler roller to convey the particulate material for discharge at the magnetic roller end. Material to be separated is therefore deposited on an upper conveying portion of the belt at an upstream end so that it is advanced towards the downstream end and is discharged as the conveyor belt moves around the magnetic roller. Magnetic components are attracted to the magnetic roller and thus have a different discharged trajectory than non-magnetic components as the various particles leave the conveyor belt at the discharge region associated with the magnetic roller. An example of such a magnetic roller assembly is shown in my U.S. Pat. No. 5,101,980 issued Apr. 7, 1992.

A second type of magnetic separation apparatus for use in separating both dry and wet, particulate aggregated or slurried material is that known as a drum separator. A typical drum separator is constructed to have a drum formed as a cylindrical shell which is rotatably journaled onto a horizontal axis. Particulate material is introduced on the outer cylindrical surface of the drum and, as the drum rotates, this particulate material is advanced and is discharged under the force of gravity so as to have a discharge trajectory. A magnetic array is disposed internally of the drum and is located proximate to the drum sidewall. The magnetic array is positioned to interact with the particulate material before it is discharged from the drum surface. Thus, as the particulate material moves past the magnetic array, the magnetic attraction between certain components of the particulate material tend to adhere to the drum surface longer than non-magnetic components. Moreover, different magnetic components of the aggregate have varying strengths of interaction with the magnetic field from the magnet array so that the differing magnetic components as well as non-magnetic components have different discharge trajectories from the drum due to a combination of the magnetic force and the gravitational and inertial forces. The differing streams of particulate materials may be separated by simple partition walls either in chutes, bins or the like, and the separated components may be further processed and refined for purity.

The present invention is directed to this second type of magnetic separation apparatus, and the present invention is constructed to provide advantages over existing magnetic drum separators. For example, one difficulty in the construction of magnetic drum separators is the organization of a magnetic array which provides a magnetic field of sufficient strength to adequately interact with the magnetic components of the feed material. Whereas magnetic roll separators are able to use conveyor belts which are relatively thin and flexible, the drum of a magnetic drum separator must be of sufficient mechanical strength and rigidity to minimize deflection of the drum sidewall for large drum separators and otherwise to support the weight of the particulate material (usually crushed ore). This requires the drums to be constructed of a non-magnetic metal or a non-conductive material having a sufficient sidewall thickness to provide the requisite structural integrity. By having a thicker sidewall, the particulate material is by necessity located an increased distance from the magnetic array than that achieved, for example, by the magnetic roll separator. This of course diminishes the strength of the magnetic field at the outer surface of the drum.

Further, due to the typical construction of the rotating drum sidewall out of a non-magnetic metal material, the movement of the sidewall through the magnetic field causes the induction of eddy currents having their own electric magnetic field components. Since the force of these fields interacting with the magnetic field from the magnetic array must be overcome by the mechanical drive for the drum itself, the support structure for the magnetic array and the drum must be adequately designed, especially where the magnetic array provides superior magnetic field strength.

SUMMARY OF THE INVENTION

It is an object of the present invention to provide a new and useful magnetic drum separator which is adapted to separate particulate aggregate material into components of differing magnetic properties.

Another object of the present invention is to provide a magnetic drum separator which has a magnetic array that provides enhanced magnetic field strength.

A further object of the present invention is to provide for the construction of a magnetic drum separator which is easy to assembly yet which provides magnetic array that produces relatively high magnetic field strength.

Still a further object of the present invention is to provide an improvement to existing magnetic drum separators which improvement comprises a magnetic array constructed to have improved field strength characteristics.

According to the present invention, then, a magnetic drum separator is adapted to receive particulate material thereon in order to separate the particulate material into different components having different magnetic properties. Broadly, the magnetic drum separator includes a support frame and a drum rotatably journaled with respect to the support frame on a longitudinally extending rotational axis. The drum has an outer sidewall formed as a cylindrical shell out of a selected material so as to have an open drum interior. A magnetic array is disposed in the drum interior, and the magnetic array is fixed relative to the support frame.

The magnetic array is configured to have an arcuate active surface which is oriented in closely-spaced relation to the drum sidewall with the magnetic array operative to produce a magnetic field at the active surface. The magnetic array includes a plurality of longitudinally extending bars which are circumferentially spaced from one another and which are formed out of a ferromagnetic material. A longitudinally extending first magnet is interposed between circumjacent ones of these bars and, preferably, a longitudinally extending second magnet is associated with each of the bars with the second magnet being located radially inwardly of a respective bar in the interior of the drum. A drive is then mechanically connected to the drum and is operative to rotate the drum on the rotational axis so that the drum sidewall moves past the magnetic array. Thus, particulate aggregated material placed on the outer surface of the drum is subjected to the magnetic field with components of the aggregate material which have different magnetic properties having different trajectories when they are discharged off of the outer surface of the drum.

Preferably, circumjacent ones of the first magnets have north and south magnetic poles aligned perpendicularly to a radial direction relative to the drum with similar magnetic poles of the circumjacent ones facing one another with a respective bar disposed therebetween. Here also, it is preferred that the second magnets have north and south magnetic poles aligned with the radial direction and that the second magnet located between circumjacent ones of the first magnets have a similar magnet pole facing the respective bar between the circumjacent first magnets. Moreover, it is preferred that each of the first magnets each be constructed out of a plurality of discrete magnetic elements which are arranged stack-wise in the longitudinal direction. Likewise, each of the second magnets may also be formed of a plurality of discrete second magnetic elements. In any event, it is preferred that both the first and second magnets be constructed of a rare earth alloy material.

In the magnetic separator, it is preferred that a rigid axle member be disposed in the interior of the drum and that the drum be rotatably journaled on bearings at either end of the rigid axle member. The magnetic array is then mounted between a pair of support brackets rigidly connected to the axle member in the interior of the drum, with each of these support brackets being formed by a pair of bracket sections that are adjustable with respect to one another to allow a degree of adjustment in the positioning of the magnetic array. An arcuate support plate may be connected to each of the support brackets to extend therebetween and to support the magnetic array at a radially inward location. The longitudinally extending bars may be connected at opposite ends to the support brackets and may also be connected to the support plate. Each of these bars may be trapezoidal in cross-section with a pair of oppositely and circumferentially projecting flanges to retain the first magnets therebetween. These first magnets may be supported against the support plate by means of longitudinally extending spacer bars which are connected at opposite ends to the support brackets. The second magnets may then be sandwiched between the support plate and the longitudinally extending bars, and retaining channels may be formed longitudinally in the support plate to nestably receive the second magnets.

Opposite annular ends may enclose the interior of the drum with these annular ends being rotatably journaled on bearings mounted to the rigid axle. A drum drive shaft may be interconnected to one of these annular ends and the drive with the drum drive shaft being rotatably journaled with respect to the frame on a shaft bearing.

The magnetic array may be selected to extend a selected arcuate distance around the axle member. Preferably, the active surface of the magnetic array is arcuate in shape and, to this end, the outer surfaces of the longitudinally extending bars which form part of the magnetic array are arcuate in shape. The array extends preferably at least 45° of arc about the axle, although it is preferred that the active surface of the magnetic array extend in a range of between 75° and 120° of arc, inclusively.

These and other objects of the present invention will become more readily appreciated and understood from a consideration of the following detailed description of the exemplary embodiment when taken together with the accompanying drawings, in which:

DETAILED DESCRIPTION OF THE EXEMPLARY EMBODIMENT

The present invention is directed to a magnetic drum separator which is useful in the separation of particulate, aggregate material into different components which have different magnetic properties. This invention may be used with both dry material, wet material and slurried material where components of differing magnetic properties are present. Accordingly, the present invention is particularly useful as initial separation process for treating finely crushed ore or other materials.

Figure 1:
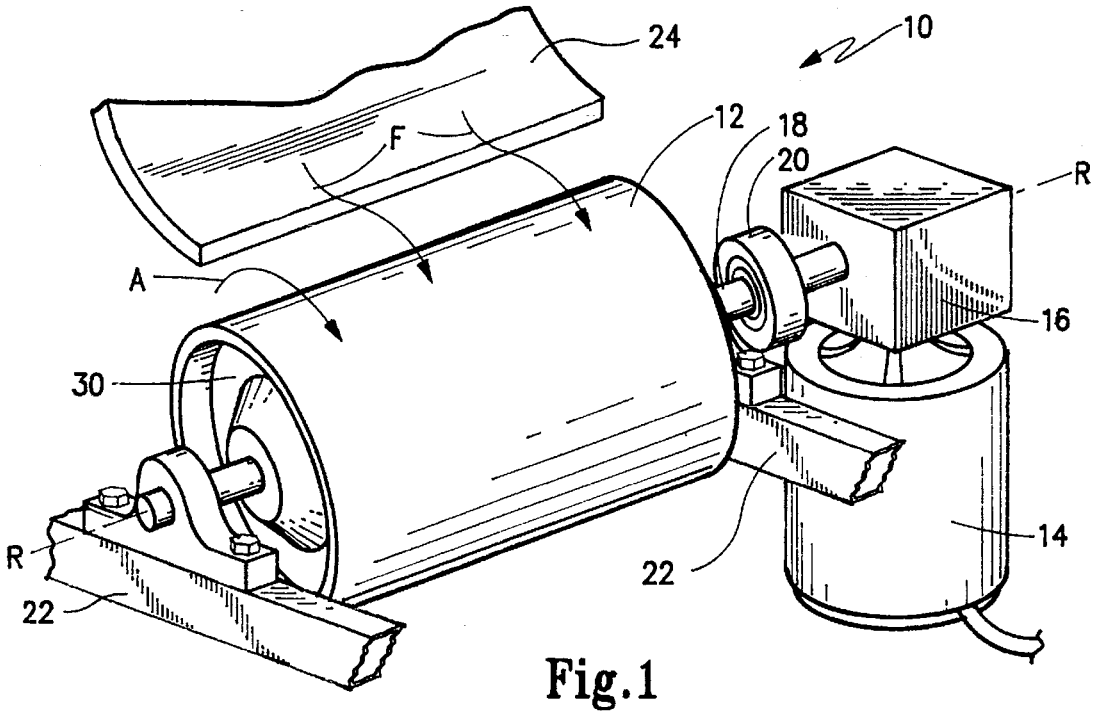
FIG. 1 is a perspective view of a magnetic drum separator according to the exemplary embodiment of the present invention.

With reference first to FIG. 1, it may be seen that magnetic drum separator 10 includes a drum 12 rotatably journaled on a rotational axis "R". Rotation is imparted, for example, by means of an electrical drive motor 14 acting through gear box 16, which turns drum drive shaft 18 through coupler 20. Drum 12 is rotatably journaled on a framework 22 with rotational axis "R" preferably being oriented horizontally. Particulate matter may be introduced onto the outer surface of drum 12 at an upper location, for example, by means of chute 24. In FIG. 1, it may be seen that representative particulate material is introduced as feed "F" with drum 12 being rotated in the direction of arrow "A".

Figure 2:
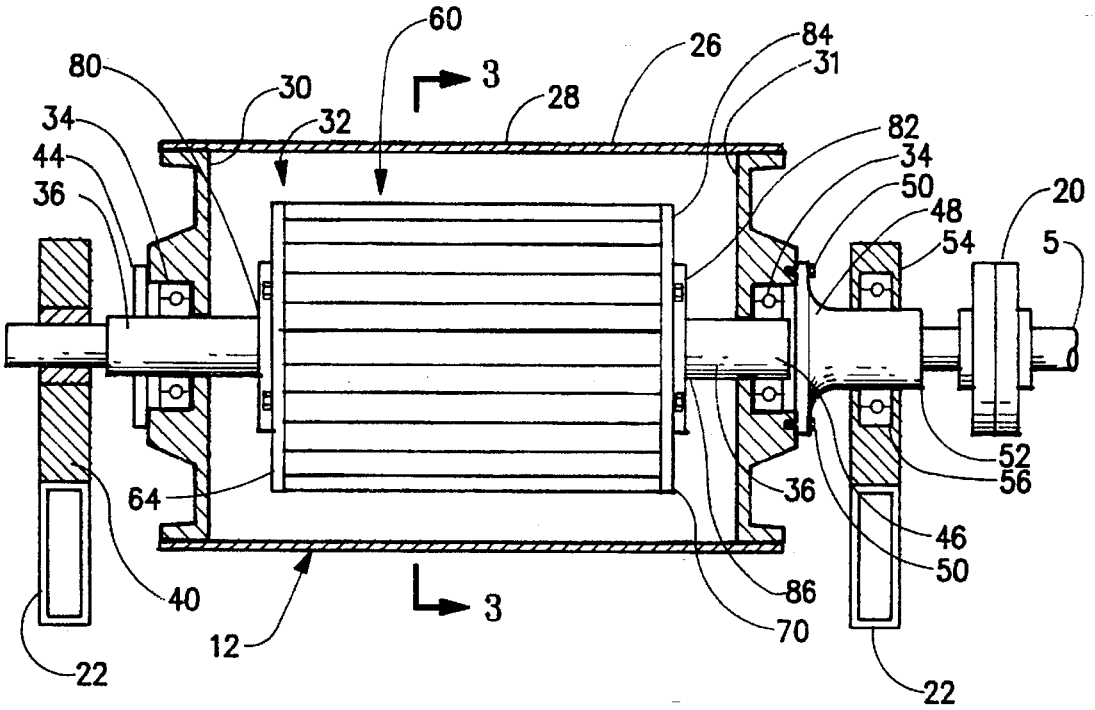
FIG. 2 is a side view in partial cross-section showing the drum and drum supports of the magnetic drum separator shown in FIG. 1.
Figure 3:
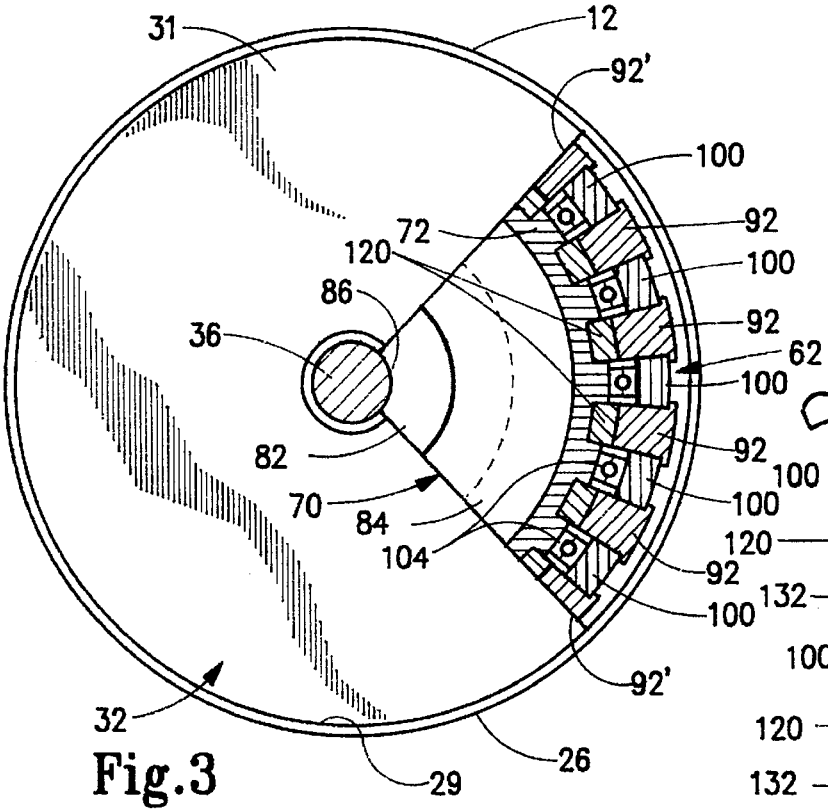
FIG. 3 is a cross-sectional view taken about lines 3—3 of FIG. 2.

With reference to FIGS. 2 and 3, it may be seen that drum 12 is formed as a hollow cylindrical shell having a sidewall 26 formed of any material suitably strong and rigid so as to be able to support the particulate material during processing. Sidewall 26 may be constructed for example, of non-magnetic steel or other metal or any other suitably strong and rigid non-conductive material. Accordingly, sidewall 26 has a cylindrical working surface 28 onto which the particulate material is placed. Annular drum end castings 30 and 31 along with drum sidewall 26 enclose a relatively open interior 32 of drum 12, and it may be seen in FIG. 2 that end castings 30 and 31 are rotatably supported by bearings 34 on a stationary or static shaft 36. A first end 38 of shaft 36 is rigidly supported by shaft clamp block 40. Clamp block 40 is in turn supported on framework 22. Shaft seal ring 44 is mounted to the end casting 30 to provide a sealing contact with shaft 36 when drum 12 is rotated.

A second end 46 of shaft 36 is rotatably supported by bearing 34 on end casting 31. Drum drive shaft 48 is secured by means of bolts 50 to end casting 31, with drive shaft 48 having a shank 52 rotatably mounted in plummer block 54 that supports bearing 56 on framework 22. Drum drive shaft 48 is then mechanically connected to drive shaft 58 from gear box 16 by means of drive shaft coupling 20, as noted above.

With reference to FIGS. 2 and 3, it may now be appreciated that a magnetic array 60 is disposed in interior 32 of drum 12. Here, magnetic array 60 has an arcuate active surface 62 and is supported radially by means of a pair of brackets 64 and 70 and an arcuate support plate 72. Support plate 72 extends longitudinally of drum 12 between brackets 64 and 70 so as to be concentric with drum sidewall 26. Active surface 62 is therefore in closely spaced concentric relation with sidewall 26 inner surface 29 as sidewall 26 rotates past active surface 62 of magnetic array 60.

Figure 4:
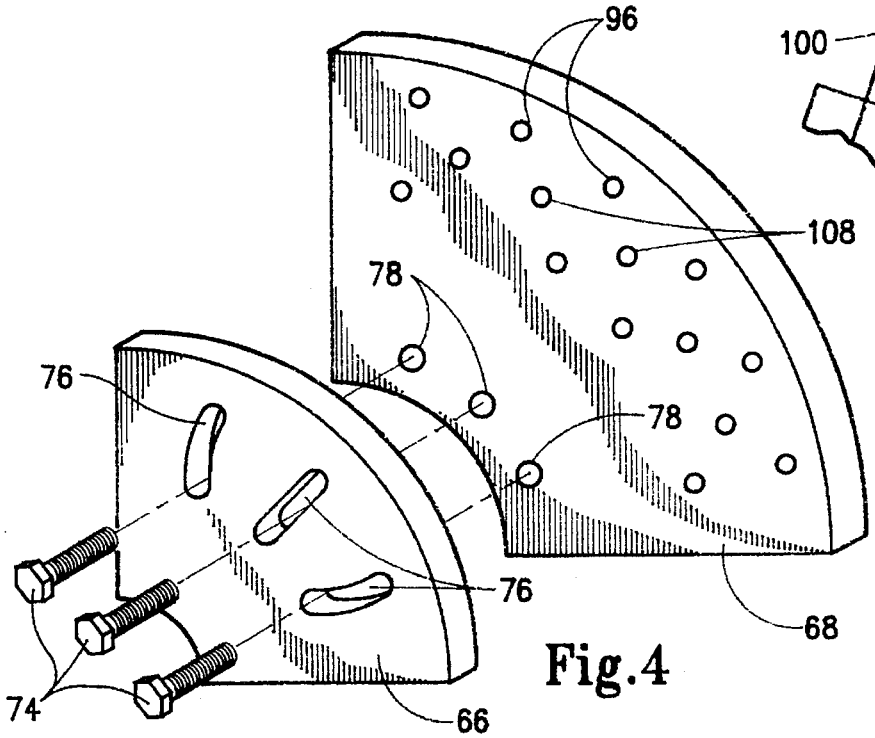
FIG. 4 is an exploded view in perspective showing the support bracket for the magnetic array shown in FIGS. 2 and 3.

To accomplish this positioning, each of brackets 64 and 70 is formed by a pair of sections. Thus, an exemplary bracket 64 is shown in FIG. 4 and includes an inner bracket piece 66 and an outer bracket piece 68 which may be bolted together by means of bolts 74 extending through slots 76 in bracket piece 66 to engage threaded bores 78 in bracket piece 68. The provision of slots 76 in inner bracket piece 66 allows for a modest amount of radial adjustment of support plate 72 and magnetic array 60. Inner bracket piece 66 is then affixed to shaft 36 for example, by weldments 80. Bracket 70 is constructed similarly as bracket 64 and has inner bracket piece 82 and an outer bracket piece 84 with inner bracket piece 82 being affixed to shaft 36, for example, by weldments 86.

The construction of magnetic array 60 may now be more fully understood, especially with reference to FIGS. 3–8. Here, it may be seen that support plate 72 is connected between brackets 64 and 70 by bolts 88 received in threaded bores 90 of support plate 72. A plurality of longitudinally extending bars 92 have arcuate outer surfaces 93 and have opposite ends bolted to brackets 64 and 70 by means of bolts 94 extending, for example, through holes 96 in outer bracket piece 68 to be threadably received in threaded bores 98 of each bar 92. As is shown in FIG. 3, bars 92 are circumferentially spaced from one another with the outer bars 92' providing the longitudinally extending lateral edges for magnetic array 60.

Figure 7:
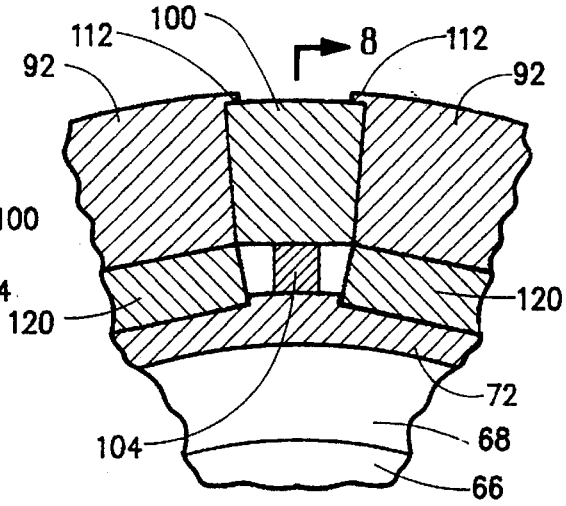
FIG. 7 is an end view in cross-section of a portion of the magnetic array shown in FIGS. 2 and 3.
Figure 8:
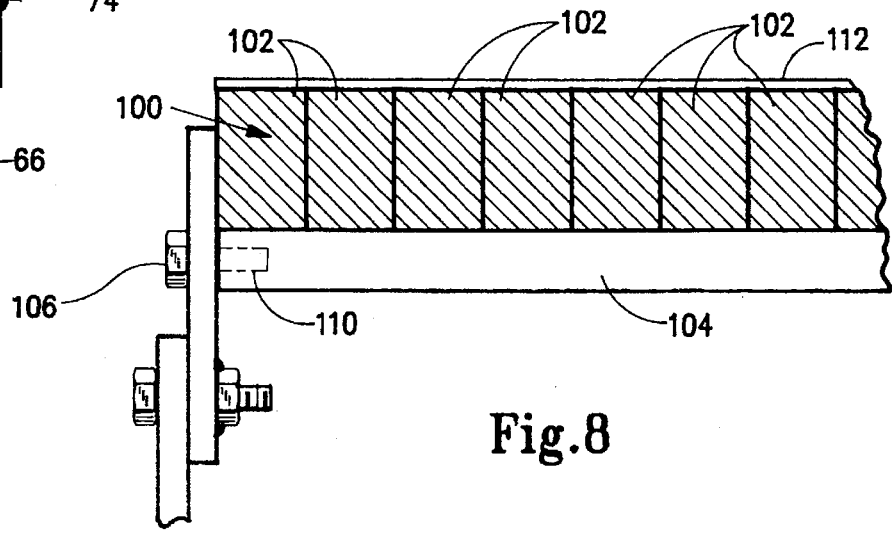
FIG. 8 is a cross-sectional view taken about lines 8—8 of FIG. 7.

A plurality of first magnets 100 extend longitudinally of magnetic array 60 and are interposed in abutting relationship between a pair of circumjacent bars 92. As is shown in FIG. 8, each of first magnets 100 is actually formed by a plurality of magnetic elements 102 organized and stack-wise relation in the longitudinal direction. Each magnetic element 102 of first magnets 100 is supported by a longitudinally extending spacer bar 104 interposed between support plates 72 and first magnets 100, as best shown in FIG. 7. Spacer bars 104 extend between brackets 64, 70 and are connected thereto by means of bolts 106 extending through holes 108, for example, in outer bracket piece 68 and received in threaded bores 110 in the opposite ends of spacer bar 104. Support plate 72 an spacer bars 104 may be constructed of any suitable material, but aluminum is preferable due to cost and weight considerations.

Figure 5:
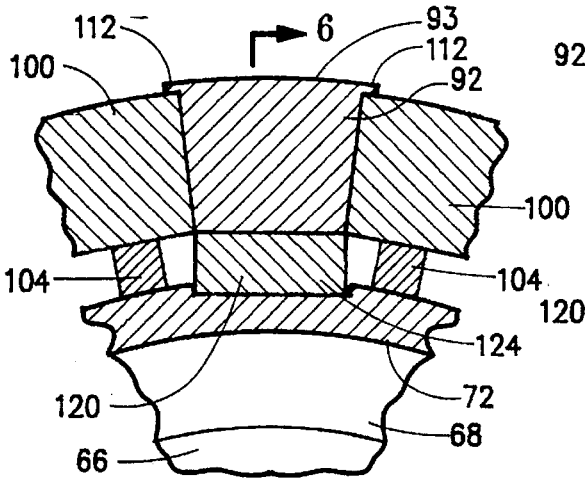
FIG. 5 is an end view of a portion of the magnetic array shown in FIG. 3.
Figure 6:
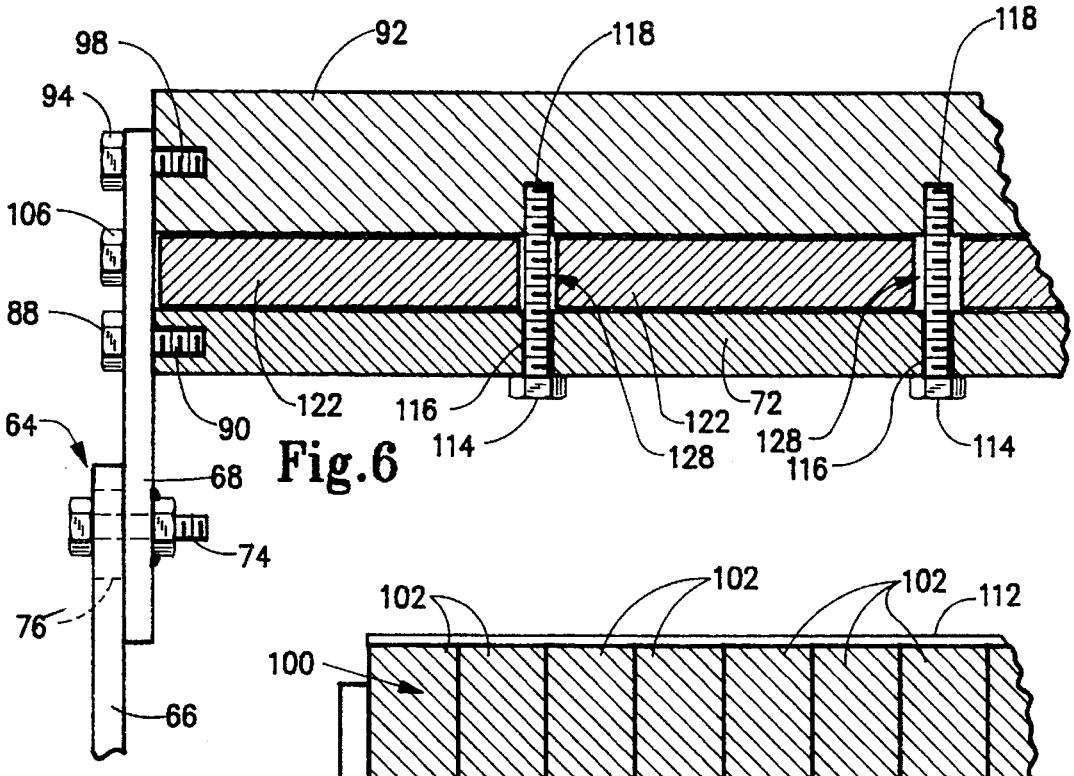
FIG. 6 is a cross-sectional view taken about lines 6—6 of FIG. 5.

As is best shown in FIG. 5, each bar 92 is generally trapezoidal in cross-section but has a pair of oppositely projecting flanges 112 so that magnets 100 are confined between spacer bars 104 and flanges 112 of an adjacent pair of bars 92. As noted above, each bar 92 extends longitudinally between brackets 64, 70 and are secured by means of bolts 94 thereto. Bars 92 are also secured to spacer bar 72 as is best shown in FIG. 6. Here, it may be seen that a plurality of bolts 114 extend through holes 116 formed radially in support plate 72 with the ends of bolts 114 being threadably secured in threaded bores 118 extending radially into each spacer bar 92. With reference to FIGS. 5 and 6, it may be seen that a second magnet 120 provides a magnetic means associated with a majority of bars 92 with second magnets 120 being interposed in abutting relationship between a respective bar 92 and support plate 72 so that each is located radially inwardly of a respective bar and extends longitudinally therealong. To this end, support plate 72 is provided with a plurality of longitudinally extending shallow channels 124, such as that shown in FIG. 5, to help locate each second magnet 120. Moreover, as is best shown in FIG. 6, each second magnet 120 may actually be provided by a plurality of second magnetic elements 122 which are separated by spaces 123 to accommodate bolts 114, noted above.

It may be appreciated that the organization of first magnets 100, second magnets 120 along with bars 92, 92' provide a superior magnetic field for magnetic drum separator 10. To this end, each magnetic element 102 of first magnets 100 as well as each magnetic element 122 of second magnets 120 are high field strength rare earth alloy magnets. It should be understood, however, that other magnets, such as ceramic ferrite magnets, rare-earth magnets and the like, could be employed depending on the field strength desired. Bars 92, 92' are constructed of low carbon steel or any suitable ferromagnetic material and act to help focus the magnetic fields from magnets 100, 120. Further, it should be appreciated by the ordinarily skilled person in this field that the circumferential width, profile shape and number of bars 92, 92' as well as the size and number of the magnets 100, 120 can be varied to achieve a desired magnetic strength and number of magnetic poles as different applications may require without departing from the scope of this invention.

Figure 9:
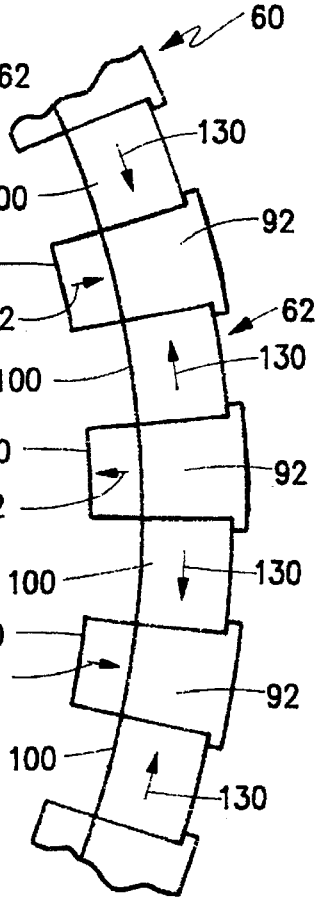
FIG. 9 is a diagrammatic view showing the organization of the magnetic poles of the magnetic array of FIGS. 2 and 3.

With reference to FIG. 9, it may now be seen that arrows 130, 132 show the direction of the magnetic poles of magnets 100 and 120 with the head of arrows 130, 132 indicating a magnetic north. In FIG. 9 it may be seen that magnets 100 have magnetic poles that are oriented perpendicularly to the radial direction with like poles of each circumjacent magnet 100 facing one another with a bar 92 located therebetween, that is, circumjacent ones of magnets 100 have oppositely oriented polarities. Moreover, each magnet 120 has magnetic poles extending radially with the direction of such poles alternating for each circumjacent magnet 120, that is, circumjacent ones of magnets 120 have oppositely oriented polarities. Here, also, it may be seen that each magnet 120 has a magnetic pole contacting bar 92 that is the same as the magnetic poles of magnets 100 that face that respective bar 92.

From the foregoing, and in reference to FIG. 9, it may be appreciated that each adjacent bar 92 has alternating polarity and is at high magnetic flux due to the organization of magnets 100 and 120. Thus, a very high magnetic field strength, approximating 0.3 to 2.2 Tesla, extends along active surface 62 with this magnetic flux extending arcuately between each adjacent arcuate surface 93 of the adjacent bars 92.

In operation, an aggregate material may be conveyed by the outer surface of drum 12. In this manner, it is advanced by sidewall 26 so that it moves past magnetic array 60 which has its arcuate active surface 62 oriented in close-spaced facing relation to the inner surface of sidewall 26. Particles in the aggregate material which have no magnetic property will discharge from drum 12 with a trajectory depending solely upon gravitational and inertial forces. However, those components which are magnetic will tend to adhere to the surface of drum 12 due to the presence of magnetic array 60. Thus, the magnetic components will have a different trajectory based on the combination of the magnetic force with the inertial and gravitational forces. Moreover, where the magnetic components differ in degree of magnetism, these components will likewise have a different amount of interaction with magnetic array 60 and therefore have different trajectories as well.

While the above invention has been described specifically with respect to the magnetic separation of aggregate material which is often in dry particulate form, it should be understood that the present invention is not limited to just a separation of dry materials. Indeed, the drum and magnetic array may be suitably oriented to receive wet, slurried materials which may also be separated by array 60 into magnetic and non-magnetic components. All that is necessary, as the ordinarily skilled artisan will realize, is the provision of the necessary troughs to hold the slurried material as well as the proper positioning of magnetic array 60 relative to the slurry material, all as is known in the art.

Accordingly, the present invention has been described with some degree of particularity directed to the exemplary embodiment of the present invention. It should be appreciated, though, that the present invention is defined by the following claims construed in light of the prior art so that modifications or changes may be made to the exemplary embodiment of the present invention without departing from the inventive concepts contained herein.

I claim:

1. In an apparatus which separates a particulate material into different components according to different magnetic properties wherein a drum has a sidewall formed as a cylindrical shell and is journaled for rotation relative to a support structure on a longitudinal axis with the drum having an open drum interior, the improvement comprising a magnetic array disposed in the drum interior with said magnetic array formed of a plurality of longitudinally extending bars circumferentially spaced from one another and constructed of a ferromagnetic material and a plurality of longitudinally extending first permanent magnets, there being one of said first magnets disposed between circumjacent ones of said bars, said bars and said first permanent magnets having a generally arcuate active surface disposed in close-spaced facing relation to an inner surface of said sidewall, said magnetic array further including a second magnet associated with each of a majority of said bars, said second magnets each located radially inwardly of a respective bar and extending longitudinally therealong, said second magnets having a polarity extending in a radial direction, said magnetic array positioned such that particulate material on an outer surface of said sidewall will be influenced by magnetic forces from said magnetic array as said sidewall is advanced thereon.

2. The improvement of claim 1 wherein circumjacent ones of said first permanent magnets have oppositely oriented polarities.

3. The improvement of claim 1 wherein circumjacent ones of said second magnets have oppositely oriented polarities and wherein circumjacent ones of said first permanent magnets have oppositely oriented polarities.

4. The improvement of claim 1 wherein said bars are trapezoidal in cross-section and have an outer arcuate surface defining a portion of the active surface.

5. The improvement of claim 4 wherein said bars each have a pair of flanges disposed proximately to the outer arcuate surface thereof and sized so that circumjacent ones of said bars have opposed flanges operative to retain a respective first permanent magnet.

6. A magnetic drum separator which receives particulate material thereon in order to separate said particulate material into different components having different magnetic properties, comprising:

(a) a support frame;

(b) a drum rotatably journaled on a longitudinally extending rotational axis with respect to said support frame, said drum having a drum sidewall formed as a cylindrical shell out of a first material and having a drum interior;

(c) a magnetic array disposed in the drum interior and fixed relative to said support frame, said magnetic array having an arcuate active surface oriented in closely-spaced relation to said drum sidewall and operative to produce a magnetic field at the active surface, said magnetic array including a plurality of longitudinally extending bars circumferentially spaced from one another and formed of a ferromagnetic material, a longitudinally extending first magnet interposed between circumjacent ones of said bars and a longitudinally extending second magnet associated with each of said bars, each said second magnet located radially inwardly of its respective said bar in the interior of said drum, each said second magnet having a central longitudinal axis and positioned within the interior so that the central longitudinal axis intersects a radial line passing through an associated one of said bars; and (d) a drive operative to rotate said drum on the rotational axis so that said drum sidewall moves past said magnetic array so that particulate material placed on an outer surface of said drum is subjected to the magnetic field whereby components of said particulate material having different magnetic properties will discharged off of said outer surface with differing trajectories.

7. A magnetic drum separator according to claim 6 wherein circumjacent ones of said first magnets have north and south magnetic poles aligned perpendicularly to a radial direction and with similar magnetic poles of said circumjacent ones facing one another with a respective bar disposed therebetween.

8. A magnetic drum separator according to claim 7 wherein each of said first magnets is constructed as a plurality of discrete magnetic elements.

9. A magnetic drum separator according to claim 7 wherein adjacent ones of said second magnets have north and south magnetic poles aligned in a radial direction with adjacent ones of said second magnets having opposite magnetic poles facing radially outwardly.

10. A magnetic drum separator according to claim 6 wherein said first and second magnets are formed of rare earth alloy material.

11. A magnetic drum separator according to claim 6 including an axle member disposed in the interior of said drum along the rotational axis, said magnetic array being supported relative to said axle member by a plurality of longitudinally spaced-apart brackets.

12. A magnetic drum separator according to claim 1 wherein each of said bars has opposite bar ends secured between first and second ones of said brackets.

13. A magnetic drum separator according to claim 12 including a longitudinally extending arcuate support plate secured between said first and second ones of said brackets so as to be oriented concentrically with respect to said drum sidewall, said second magnets being disposed between said arcuate support plate and said bars.

14. A magnetic drum separator according to claim 6 wherein the active surface of said magnetic array extends at least 45° of arc.

15. A magnetic drum separator according to claim 14 wherein the active surface of said magnetic array extends in a range of between 75° and 120° of arc, inclusively.

16. A magnetic drum separator according to claim 6 wherein the active surface of said magnetic array is radially adjustable in position.

17. A magnetic drum separator which receives particulate material thereon in order to separate said particulate material into different components having different magnetic properties, comprising:

(a) a support frame;

(b) a drum rotatably journaled on a longitudinally extending rotational axis with respect to said support frame, said drum having a sidewall formed as a cylindrical shell out of a first material and having a drum interior;

(c) a rigid axle member disposed in the interior of said drum along the rotational axis;

(d) a pair of longitudinally spaced-apart brackets oriented in planes perpendicular to the rotational axis and rigidly secured to said axle member;

(e) a longitudinally extending arcuate support plate secured between said brackets so as to be oriented concentrically with respect to said drum sidewall and spaced radially inwardly thereof;

(f) a plurality of longitudinally extending bars circumferentially spaced from one another and formed of a ferromagnetic material, said bars each secured at opposite bar ends to said brackets and spaced radially outwardly of said support plate;

(g) a plurality of longitudinally extending first magnet means for creating a magnetic field, there being a respective first magnet means interposed between adjacent ones of said bars and supported against said support plate, said first magnet means each having an outer first magnet surface and said bars each having an outer bar surface such that the outer first magnet surfaces and the outer bar surfaces forming an arcuate active surface oriented in closely spaced relation to said drum sidewall; and (h) a drive operative to rotate said drum on the rotational axis so that said sidewall moves past the active surface so that particulate material placed on an outer surface of said drum is subjected to a magnetic field whereby components of said particulate material having different magnetic properties will be discharged off of said outer surface with differing trajectories.

18. A magnetic drum separator according to claim 17 wherein each of said brackets is formed by a pair of bracket sections which are adjustably connected to one another whereby the active surface may be radially adjustable in position.

19. A magnetic drum separator according to claim 17 wherein each of said first magnet means is formed by a plurality of discrete first magnets arranged stack-wise in a longitudinal direction.

20. A magnetic drum separator according to claim 17 wherein said drum has opposite annular ends enclosing the interior thereof, said annular ends rotatably journaled on bearing mounted to said rigid axle.

21. A magnetic drum separator according to claim 20 including a drum drive shaft interconnecting to one of said ends and said drive, said drum drive shaft rotatably journaled with respect to said frame on a shaft bearing.

22. A magnetic drum separator which receives particulate material thereon in order to separate said particulate material into different components having different magnetic properties, comprising:

(a) a support frame;

(b) a drum rotatably journaled on a longitudinally extending rotational axis with respect to said support frame, said drum having a sidewall formed as a cylindrical shell out of a first material and having a drum interior;

(c) a rigid axle member disposed in the interior of said drum along the rotational axis;

(d) a pair of longitudinally spaced-apart brackets oriented in planes perpendicular to the rotational axis and rigidly secured to said axle member;

(e) a longitudinally extending arcuate support plate secured between said brackets so as to be oriented concentrically with respect to said drum sidewall and spaced radially inwardly thereof;

(f) a plurality of longitudinally extending bars circumferentially spaced from one another and formed of a ferromagnetic material, said bars each secured at opposite bar ends to said brackets and spaced radially outwardly of said support plate;

(g) a plurality of longitudinally extending first magnet means for creating a magnetic field, there being a respective first magnet means interposed between adjacent ones of said bars and supported against said support plate, said first magnet means each having an outer first magnet surface and said bars each having an outer bar surface such that the outer first magnet surfaces and the outer bar surfaces forming an arcuate active surface oriented in closely spaced relation to said drum sidewall;

(h) a plurality of second magnet means, there being a second magnet means disposed between said support plate and each of said bars for augmenting the magnetic field; and (i) a drive operative to rotate said drum on the rotational axis so that said sidewall moves past the active surface so that particulate material placed on an outer surface of said drum is subjected to a magnetic field whereby components of said particulate material having different magnetic properties will be discharged off of said outer surface with differing trajectories.

23. A magnetic drum separator according to claim 22 wherein each of said second magnet means abuts its respective said bar and said support plate, and including a spacer bar between said support plate and each respective first magnet means, said spacer bars having opposite spacer bar ends secured to said brackets.

24. A magnetic drum separator according to claim 23 wherein each of said second magnet means is formed by a plurality of discrete second magnets longitudinally aligned with one another.

25. A magnetic drum separator according to claim 22 wherein adjacent ones of said first magnet means have north and south magnetic poles aligned perpendicularly to a radial direction and with similar magnetic poles of said adjacent ones facing one another with a respective bar disposed therebetween and wherein adjacent ones of said second magnet means have north and south magnetic poles aligned in a radial direction with adjacent ones of said second magnet means having opposite magnetic poles facing radially outwardly.

* * * * *